United States Patent [19]

Piotter

[11] Patent Number: 4,931,171

[45] Date of Patent: Jun. 5, 1990

[54] PYROLYSIS OF CARBONACEOUS MATERIALS

[75] Inventor: Douglas R. Piotter, Bartlesville, Okla.

[73] Assignee: Phillips Petroleum Company, Bartlesville, Okla.

[21] Appl. No.: 404,680

[22] Filed: Aug. 3, 1982

[51] Int. Cl.[5] ..... C10G 1/00; C10B 53/06

[52] U.S. Cl. ..... 208/409; 208/407; 208/427

[58] Field of Search ..... 208/11 R, 409, 407, 208/427; 201/31, 27, 37

[56] References Cited

U.S. PATENT DOCUMENTS

| | | | |
|---|---|---|---|
| 3,247,092 | 4/1960 | Huntington | 208/8 R |
| 3,318,798 | 5/1967 | Kondis et al. | 208/11 R |
| 3,454,383 | 7/1969 | Pirsh et al. | 201/31 X |
| 3,484,364 | 12/1969 | Hemminger | 208/11 R |
| 3,526,586 | 9/1970 | Saxton | 208/11 R |
| 3,573,194 | 3/1971 | Hopper et al. | 208/11 R |
| 3,617,466 | 11/1971 | Todd | 201/37 X |
| 3,617,471 | 11/1971 | Schlinger et al. | 208/27 X |
| 3,736,247 | 5/1973 | Jones, Jr. et al. | 208/11 R |
| 3,922,215 | 11/1975 | Linden et al. | 48/197 R |
| 4,042,485 | 8/1977 | Jones, Jr. et al. | 208/11 R |
| 4,205,524 | 6/1980 | Schirmer | 60/39.06 |
| 4,222,850 | 9/1980 | Matthews | 208/11 R |

*Primary Examiner*—Glenn Caldarola

*Attorney, Agent, or Firm*—Williams, Phillips & Umphlett

[57] ABSTRACT

A process for the pyrolysis of carbonaceous materials at an elevated temperature or an elevated temperature and an elevated pressure in which a fuel is burned in the presence of a combustion supporting material, in an amount sufficient to supply at least the stoichiometric amount of oxygen for combustion of all of the fuel, to produce an effluent containing significant amounts of nitrogen and carbon dioxide and having an elected temperature, passing the effluent to a pyrolysis zone, wihtout removal of components therefrom, to thereby create an elevated temperature within the pyrolysis zone and pyrolyzing the carbonaceous material in the pyrolysis zone in the presence of the effluent from the burning step and at an elevated temperature. The burning step may additionally be carried out at a high flame velocity to produce an effluent having an elevated pressure and the carbonaceous material may thus additionally be pyrolyzed at an elevated pressure.

31 Claims, 7 Drawing Sheets

PYROLYSIS OF CARBONACEOUS MATERIALS

BACKGROUND OF THE INVENTION

The present invention relates to the pyrolysis of carbonaceous materials. More specifically, the present invention relates to the pyrolysis of carbonaceous materials involving a novel method of supplying heat or heat and pressure to the reaction.

Numerous processes in the chemical industry require substantial amounts of heat to bring about physical and/or chemical reactions. Normally such heat is supplied by process heaters, steam boilers and the like. Unfortunately, these conventional techniques result in substantial losses of heat. For example, stack losses alone amount to about 19% of the heat produced. In addition, there are normally losses in transmitting the heat from the point of production to the point of use, which in many cases can range from 3% to 20%. Additional losses occur where indirect methods of heating are employed, such as passing the material to be treated or the heat transfer medium through tubes or utilizing solid-to-solid heat transfer techniques. In addition, most such processes also require a maintenance of high pressures. Consequently, substantial additional energy is required in the compression of gases, etc. to maintain elevated pressures.

The above-mentioned energy requirements and energy losses, in supplying heat or heat and pressure, are particularly troublesome in processes for the pyrolysis of normally solid, carbonaceous materials. The anomaly in this situation is that the pyrolysis of carbonaceous materials is designed to recover materials which can be utilized as sources of energy, while at the same time present techniques for supplying heat or heat and pressure to the process consume substantial amounts of energy derived either from utilizing the products of the process itself or outside sources of energy.

Pyrolysis of oil shale is an outstanding example of the above. In the pyrolysis of oil shale, there are three basic heating methods. In "directly heated" processes, heat is supplied burning a fuel, which may be recycled retort off gas, with air (or oxygen) within the bed of shale. Depending on flow conditions, some portion of either the coke residue or the unretorted organic matter may be burned as well. In many designs, most, or even all the heat is provided by combustion of the kerogen or coke residue. In addition, such retorting produces significant amounts of hydrogen, the presence of which is beneficial to the retorting operation. For example, conducting the retorting operation in a hydrogen atmosphere serves to convert sulfur to hydrogen sulfide, thereby removing the same, and also to break down heavy materials by reforming. However, the in situ burning to produce heat for the process burns substantial amounts of the thus produced hydrogen and it is, therefore, necessary, if the desirable functions of hydrogen are to be retained, to supply make up hydrogen. The most usual process for producing hydrogen is by steam reforming of natural gas (first desulfurized, if high in sulfur) over a catalyst, such as a nickel catalyst. The reaction of the methane in water thus produces carbon monoxide and hydrogen. In order to obtain additional hydrogen, the effluent is subjected to a shift reaction over another catalyst, whereby the carbon monoxide and water react to produce carbon dioxide and additional hydrogen. Finally, the end product is treated in some manner to separate a concentrated stream of hydrogen. This process is a highly energy intensive process and contributes a substantial amount to the cost of operating a pyrolysis process. If oxygen is utilized as an oxidizing agent in the retorting operation, a separate operation to produce oxygen is necessary, which again is highly energy intensive. For example, a conventional operation is usually a cryogenic separation of oxygen from air involving liquifaction by the Joule-Thompson effect (throttling), expansion and vaporization. On the other hand, if air is utilized as an oxidizing agent, in the retorting operation, the off gas has a low caloric value (CV), for example, about 3.3 $MJ/m^3$. The other two techniques for supplying heat in the retorting of shale are "indirectly heated" processes in which a separate furnace is used to raise the temperature of a heat transfer medium that is then injected into the retort to provide the heat. The two subclasses of indirectly heated retorts arise according to whether a solid or gaseous heat transfer medium is utilized. In the case of a gas, the shale is heated by gas-to-solid heat exchange. This is generally accomplished by recycling the off gas through a separate furnace to heat the gas by indirect heat exchange and then passing the hot gas to the retort. If a solid is utilized, heating is by solid-to-solid exchange. In this technique, at least a part of the spent shale or an inert material, such as ceramic balls, is heated in a separate furnace and the solid heat transfer medium is then transported to the retort. Both of the indirectly heated retorting techniques produce a medium CV off gas. It is obvious that all of these techniques require substantial amounts of energy and that substantial amounts of energy are also lost in utilizing such heating techniques.

The different types of oil shale also present their own peculiar processing problems which add to the problems of oil shale retorting. The two main types of oil shale include Green River or Mahogany zone (western) and Devonian or New Albany shale (eastern). Green River oil shale contains substantial amounts of carbonates in the form of dolomite and calcite, which are generally absent in the Devonian shale. The presence of carbonates presents a serious problem in the retorting of Green River Shale. Conventionally, liquid production is most rapid at about 425° C. and the production of gases, namely, hydrogen and methane peaks at about 460° C. Primary decomposition of liquids and gases is virtually complete at about 470° C. Above 500° C. secondary decomposition of char and gases takes place. However, at 500° C. and higher, carbonate decomposition occurs which is detrimental to the retorting process. On the other hand, Devonian shale is low in hydrogen, compared to Green River shale, and high in sulfur, compared to Green River shale. Consequently, conventional low pressure retorting results in substantial reductions in the recovery of liquids and gases (about half that of Green River shale) and the liquid and gaseous products contain substantial amounts of sulfur. As previously indicated, retorting in a hydrogen atmosphere is beneficial in the processing of Green River shale to the extent that it reduces coking, aids in reforming heavy materials and removes sulfur. However, when utilized in the retorting of Devonian shale, it increases liquid and gas production where product recovery is essentially equal to that from Green River shale and removes sulfur in addition to reducing coking, etc. However, supplying sufficient hydrogen requires production of hydrogen by an energy intensive outside process, as well as additional costs for the compression of the hydrogen, since such hydropyrolysis is carried out at high pressures and it appears that the higher the pressure, the more beneficial the result. Consequently, additional energy is required for the compression of the hydrogen stream to maintain the high pressure in the retort.

While the above example discusses the problems and inefficiencies in the pyrolysis of oil shale, most of these problems are also present in the pyrolysis of other carbonaceous materials, such as coals, lignites, tar sands, biomass, etc.

SUMMARY OF THE INVENTION

It is, therefore, an object of the present to provide an improved process which overcomes the above-mentioned and other problems of the prior art. Another object of the present invention is to provide an improved process for the pyrolysis of carbonaceous materials. A further object of the present invention is to provide an improved process for supplying heat or heat and pressure for the pyrolysis of carbonaceous materials. Yet another object of the present invention is to provide an improved process for the pyrolysis of carbonaceous materials which substantially reduces the energy requirements of the process. Another and further object of the present invention is to provide and improved process for the pyrolysis of carbonaceous materials which substantially reduces heat losses. A further object of the present invention is to provide an improved process for the pyrolysis of carbonaceous materials which reduces the amount of make-up hydrogen necessary. Another and further object of the present invention is to provide an improved process for the hydropyrolysis of carbonaceous materials which reduces the amount of make up hydrogen necessary. Yet another object of the present invention is to provide an improved process for the pyrolysis of carbonaceous materials in which heat or heat and pressure are supplied to the process by burning a fuel and passing the effluent from the burning step directly to the pyrolysis step. A still further object of the present invention is to provide an improved process for the pyrolysis of oil shale having a high carbonate content which substantially reduces the decomposition of carbonates. Another and further object of the present invention is to provide an improved process for the pyrolysis of oil shales having low hydrogen contents and high sulfur contents wherein liquid and gas recovery is substantially increased and desulfurization is increased. Still another object of the invention is to provide an improved process for the pyrolysis of carbonaceous materials wherein heat or heat and pressure is provided by burning a fuel and passing the effluent from the burning step directly to the pyrolysis step and utilizing at least a part of the off gas from the pyrolysis step as a fuel for the burning step. Another object of the present invention is to provide an improved process for the pyrolysis of carbonaceous materials wherein heat or heat and pressure are provided by burning a fuel and passing the effluent from the burning step directly to the pyrolysis step wherein the heat and/or pressure supplied by the burning step effluent is effectively controlled. These and other objects and advantages of the present invention will be apparent from the following description.

In accordance with the present invention, carbonaceous materials are pyrolyzed at an elevated temperature or elevated temperatures and pressures by burning a fuel in the presence of an oxidizing agent to produce an effluent having a high temperature or a high temperature and a high pressure and containing significant amounts of nitrogen and carbon dioxide, passing the effluent directly to the pyrolysis step to thereby supply heat or heat and pressure for the pyrolysis reaction and pyrolyzing the carbonaceous material in the presence of the burning step effluent. Optionally, the pyrolysis is carried out in a hydrogen atmosphere.

DESCRIPTION OF THE PREFERRED EMBODIMENTS

Figure 1:
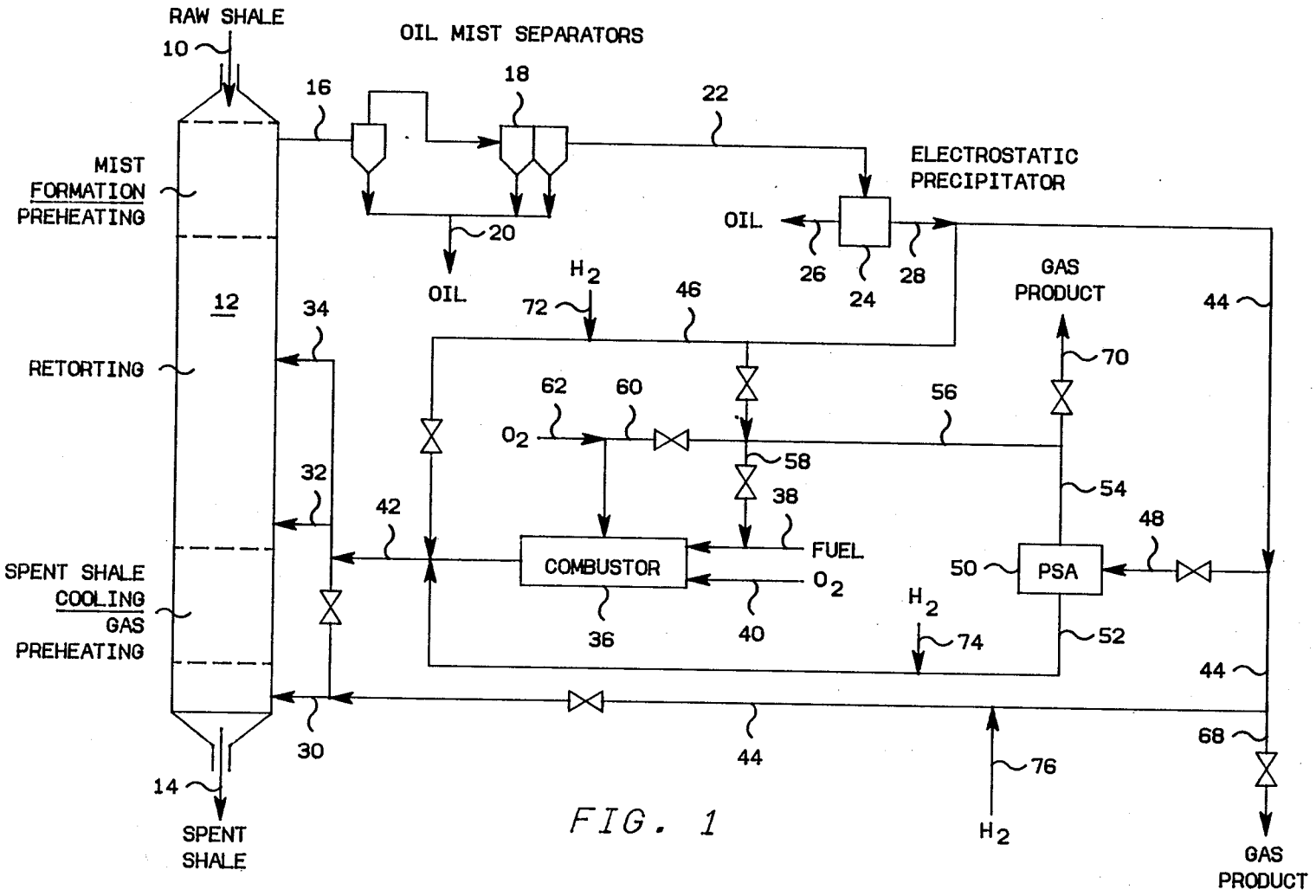
FIG. 1 of the drawings is a flow diagram illustrating the process for pyrolyzing oil shale in accordance with the present invention.

The term "fuel", when utilized herein, is meant to include normally gaseous fuels, such as natural gas, propane, etc., any normally liquid fuel, such as No. 2 fuel oil, No. 6 fuel oil, diesel fuels, crude oil, other hydrocarbon fractions, shale oils, coal oils, etc., including pre-vaporized liquid fuels, or normally solid ash-containing or ashless fuels, such as solvent refined coal oil, asphaltene bottoms, normally solid carbonaceous fuels, such as anthracite coal, bituminous coal, sub-bituminous coal, lignite, peat, petroleum coke, coal, coke, etc.

The term "combustion supporting material", "oxidant", "oxidizing gas" or "oxidizing agent" is meant to include any material capable of supplying oxygen in an amount sufficient to support combustion of a fuel, including without limitation, air, oxygen, oxygen-enriched air, oxygen containing materials, etc.

The term "normally solid carbonaceous materials" or "carbonaceous materials" is meant to include oil shales, anthracite coal, bituminous coal, sub-bituminous coal, lignite, peat, petroleum coke, coal, coke, tar sands, biomass, etc., provided only that the carbonaceous material is pyrolyzable to produce liquid and/or gaseous products.

When the phrase "passing the or said effluent directly to a pyrolysis zone" or "the or said effluent is passed directly to the pyrolysis zone", utilized herein, this phrase is meant to include passing the total effluent from a burning step to a pyrolysis zone, without component separation and utilizing no transmission lines between the burning step and the pyrolysis step or only such transmission lines which are necessary to distribute the effluent in the pyrolysis zone or introduce the effluent to a multiplicity of points in the pyrolysis step.

In accordance with the present invention, carbonaceous materials are pyrolyzed at an elevated temperature or an elevated temperature and an elevated pressure by burning a fuel in the presence of an oxidizing agent to produce a high temperature effluent comprising principally nitrogen and carbon dioxide, passing the burning step effluent to a pyrolysis zone to thereby supply heat or heat and pressure for the pyrolysis reaction, and pyrolyzing the carbonaceous material in the presence of the burning step effluent.

Normally solid carbonaceous materials which can be utilized in accordance with the present invention include any carbonaceous material capable of being pyrolyzed to produce liquid and/or gaseous products, including without limitation, oil shales, anthracite coal, bituminous coal, sub-bituminous coal, lignite, peat, petroleum coke, coal, coke, tar sands, biomass, etc.

Fuels which can be utilized in the burning step include normally gaseous fuels, such as natural gas, propane, etc., normally liquid fuels, such as No. 2 fuel oil, No. 6 fuel oil, diesel fuels, crude oils, other hydrocarbon fractions, shale oils, coal oils, etc., including pre-vaporized liquid fuels, or normally solid ash containing or ashless fuels, such as solvent refined coal oil, asphaltene bottoms, normally solid carbonaceous fuels, such as anthracite coal, bituminous coal, sub-bituminous coal, lignite, peat, petroleum coke, coal, coke, etc. As will be pointed out hereinafter, where preferred combustors and burning techniques utilizable in accordance with the present invention are utilized in the burning step, any readily available fuel, including the normally gaseous, normally liquid or normally solid fuels, such as those mentioned above, are capable of producing a burning step effluent, essentially free of particulate matter and unburned fuel.

The combustion supporting material utilized in the burning step can include any conventional combustion supporting material capable of supplying sufficient oxygen for combustion of the fuel and includes materials such as oxygen, air, oxygen-enriched air, and other oxygen containing materials.

The fuel/combustion supporting material equivalence ratio to be utilized in the burning step is selected to be at least equal to the stoichiometric ratio for essentially complete combustion of the fuel. In order to assure essentially complete combustion and reduce the production of particulate materials and unburned fuel to a minimum, a slight excess of combustion supporting material is utilized, for example, 3% excess oxygen on a dry basis.

Where an elevated pressure, in addition to an elevated temperature, is to be utilized in the pyrolysis step, the burning step can be carried out in a high intensity combustor so as to produce an effluent under a high pressure. As will also be pointed out in the discussion of the combustors and combustion techniques utilizable herein, both the temperature and the pressure of the burning step effluent can be readily controlled to provide any elevated temperature and/or elevated pressure required for the conduct of the pyrolysis step.

As will be pointed out hereinafter, the nitrogen and carbon dioxide content of the burning step effluent are generally inert or the conditions of the pyrolysis step can be carried out so as to minimize any detrimental effect of these materials in the pyrolysis step. As is also pointed out hereinafter, there are instances in which the presence of these materials are highly advantageous.

A critical factor, in accordance with the present invention, is that the total burning step effluent, without the removal or separation of components thereof, is passed to the pyrolysis zone or the total burning step effluent, without the removal of components therefrom or the separation thereof, is passed directly to the pyrolysis zone in a manner such that transmission lines between the burning step and the pyrolysis step are maintained at a minimum and include only such transmission lines or means necessary for distribution of the effluent from the burning step in the pyrolysis step or the introduction of the effluent from the burning step at a plurality of points in the pyrolysis step. Such transmission of the total burning step effluent from the burning step to the pyrolysis step has numerous advantages, the sum total of which include substantial savings in the energy requirements of the overall operation. These advantages will be pointed out at appropriate points in the discussion of specific pyrolysis techniques. While the following discussion of pyrolysis techniques is directed to the pyrolysis of specific normally solid carbonaceous materials it is to be understood that such techniques are illustrative only and one skilled in the art can readily recognize the applicability thereof to the pyrolysis of other normally solid carbonaceous materials.

As is pointed out in the introductory portion hereof, in the pyrolysis of normally solid carbonaceous materials, hydrogen is inherently produced in most pyrolysis reactions and carrying out pyrolysis in the presence of hydrogen is highly advantageous, to the extend that it removes sulfur and/or nitrogen from the normally solid carbonaceous materials, enhances the production of more desirable liquid materials by reforming of heavy liquids, reduces coking in the pyrolysis reaction and permits the utilization of high pressures without reduction in liquid yields in the pyrolysis step. Consequently, in conventional pyrolysis operations, make-up hydrogen is often added to replace that consumed so as to take advantage of the above-mentioned benefits of the presence of hydrogen. In addition, substantial volumes of hydrogen or high hydrogen partial pressures are maintained in pyrolysis techniques known as "hydropyrolysis". In such processes, the higher hydrogen partial pressures are uniquely beneficial, particularly in the pyrolysis of eastern or Devonian type oil shales where it has been demonstrated that hydropyrolysis increases liquid yields about two-fold over that obtained by conventional pyrolysis techniques. Accordingly, the present invention includes such pyrolysis in the presence of hydrogen and such hydropyrolysis, in some cases, significantly reduces the amounts of make-up hydrogen required.

By way of specific example, in the pyrolysis of oil shales, volatilization begins in the temperature range of about 662° F. to 752° F., peaks at about 797° F. and is virtually completed at about 878° F. to 932° F. Hydrogen and methane production peaks at about 860° F. and primary decomposition of liquids and gases is virtually complete at about 878° F. Above about 932° F., secondary decomposition of char and gases takes place. However, in the pyrolysis of Green River or western type oil shales, temperatures above about 932° F. are avoided, since such shales contain substantial amounts of carbonates which begin decomposing at this temperature and will generally detrimentally affect the pyrolysis reaction. In conventional pyrolysis, there is generally no advantage in operating at an elevated pressure. In fact, in the pyrolysis of Green River or western type shales, a pressure increase often causes a sharp decline in liquid production, with some increase in the gas production and the hydrogen/carbon ratio of the oil produced. However where pyrolysis is carried out in a hydrogen atmosphere or hydropyrolysis is carried out, both the processing of Green River or western type shales and the processing of Devonian or eastern type shales are significantly improved. For example, it is reported that there is a moderate increase in liquid production in the processing of Green River shale or western type shales and a substantial increase (by a factor of about 2) in the processing of Devonian type shales. The hydrogen, as previously pointed out, also inhibits coking, decreases the sulfur and oxidant content of the liquid products, improves the liquid products by reforming heavy materials, and in some cases reduces the nitrogen content of the liquid products. Specifically, the sulfur and nitrogen of the carbonaceous material is converted to hydrogen sulfide and ammonia, respectively, which are more readily removed from the product gases than from the product liquids. Hydropyrolysis is generally carried out at about the same temperatures employed in conventional pyrolysis while maintaining pressures up to about 507 psi.

A number of distinct advantages flow from the passage of the total burning step effluent to the pyrolysis step. As previously pointed out, one method of indirect heating in shale pyrolysis or retorting is to separate the pyrolysis gas product from the liquid product to produce a pyrolysis off gas, heat the pyrolysis off gas in a separate process heater and then recycle the pyrolysis off gas to the pyrolysis or retorting step. By comparison, the pyrolysis off gas is recycled to the pyrolysis step in accordance with the present invention without intermediate heating and accordingly, the lower temperature of the pyrolysis off gas will extract more sensible heat from spent shale prior to removal of the spent shale from the retort. Thus substantial savings in fuel are attained. Also where direct heating of a pyrolysis zone or retorting zone is carried out in accordance with the prior art, oxygen and in some cases, make-up hydrogen, are utilized. In such direct heating methods, a substantial volume of the hydrogen present in the pyrolysis zone is burned to produce heat for pyrolysis. As previously pointed out, both the production of oxygen and the production of hydrogen for such pyrolysis operations are highly energy intensive processes. Accordingly, in the present invention, the burning of the hydrogen in the pyrolysis zone is essentially eliminated, thereby substantially reducing overall energy requirements.

It is also to be recognized that, in accordance with the present invention, the least expensive fuel available can be utilized in the burning step, irrespective of the nature of the fuel.

It is also to be recognized that in the pyrolysis of Green River or western type shales, the presence of carbon dioxide from the burning step substantially reduces the decomposition of carbonates present in the shale and thereby reduces the detrimental effects thereof.

Where the pyrolysis is to be carried out at an elevated pressure, the burning step effluent can be introduced to the pyrolysis step at any desired high pressure. This also is a distinct advantage and results in substantial overall energy savings, to the extent that the expansion of the gases during combustion supplies a substantial part of the high pressure. Accordingly, the necessity of compressing recycle pyrolysis off gas and/or hydrogen supplied to the pyrolysis step are eliminated and the only compression energy required is that necessary to compress an oxidizing gas for the burning step and/or a normally gaseous fuel, if such fuel is utilized in the burning step. The latter obviously requires less energy than compression of pyrolysis off gas and/or hydrogen in accordance with the prior art.

In the pyrolysis of coals, volatilization begins in the range of about 662° F. to 752° F., reaches a sharp peak at about 842° F. and drops off above about 932° F. In the hydropyrolysis of coals, temperatures above about 1472° F. are utilized.

The pyrolysis of tar sands generally is carried out in the neighborhood of about 1112° F. However, the temperatures vary significantly in the pyrolysis of tar sands, depending on the type of tar sand. Where fast pyrolysis or flash pyrolysis is carried out, higher yields of synthetic crude have been reported as compared with equivalent slow pyrolysis at the same temperature.

In the pyrolysis of biomass, the quantity of char, tars, and gases evolved is strongly dependent both on the rate of heating and the final temperature obtained. A typical temperature is in the order of about 1265° F. However, both liquid and gas yields are enhanced by increasing heating rates and by higher pyrolysis temperatures.

The technique of the present invention is also useful in the direct liquifaction of coal in the presence of hydrogen. Generally, such direct liquifaction is carried out in the presence of suitable catalysts. Generally, temperatures of about 842° F. to 887° F. and pressures of about 1449 to 2899 psi and often as high as 4348 psi are utilized.

It should be recognized that the above conditions are by way of example, and thus are illustrative only, and that the conditions will vary in accordance with the type of carbonaceous material pyrolyzed as well as the products desired. However, such variations are well within the knowledge of one skilled in the art.

The objects and advantages of the present invention are further illustrated by the following discussion with reference to the figures of the drawings.

FIG. 1 of the drawings illustrates the retorting of shale in accordance with the preferred embodiment of the present invention. Normally, such oil shale retorts are either moving, packed beds or solids mixers. It should be recognized, however, that such retorting may be utilized in the pyrolysis of other carbonaceous materials and that the pyrolysis of shale can also be carried out by the techniques hereinafter described with relation to FIG. 2.

In accordance with FIG. 1, raw shale crushed to an appropriate size, for example between about 5 and 75 mm, is introduced at point 10 and moves continuously downwardly by gravity through retort 12. Spent shale is withdrawn at point 14. As shown in the drawing, retort 12 comprises a plurality of consecutive zones where various functions occur. For example, in the lowermost section, spent shale is cooled while gases introduced at the bottom of retort 12 are heated. In the next upper zone, some combustion of char occurs, thus supplying a part of the heat needed for retorting, and the actual retorting occurs. In the uppermost zone, the liquid and gaseous products form as a mist and also preheat the raw shale. The liquid and gaseous products are discharged from the top of retort 12 through line 16 to a series of oil mist separators 18, which separate a portion of the product oil, and discharge the same for further use through line 20. From the mist separators, the remaining liquid product and the retort off gas are passed through line 22 to an electrostatic precipitator 24. In electrostatic precipitator 24, the remainder of the liquid oil product is separated and discharged through line 26, as product, while the oil-free retort off gas is discharged through line 28. The utilization of the oil mist separators and electrostatic precipitator to separate liquid product from retort off gas is conventional in the art and obviously other techniques for separating liquid product from retort off gas could be utilized in the present invention.

In accordance with conventional practice, the retort off gas, when removed, is at a temperature of about 149° F. In an indirect heated conventional operation, where the off gas is utilized as a heat transfer medium, the retort off gas would be passed in indirect heat exchange through a conventional process heater or furnace and then reintroduced into the bottom of retort 12. In a directly heated conventional operation, the retort off gas, together with a fuel, if necessary, and air (or oxygen) would be introduced into the retort, wherein the retort off gas and/or fuel is burned to provide heat in situ in retort 12. Conventionally, the heated retort off gas or the retort off gas, oxygen and fuel, if utilized are introduced to retort 12 through line 30 at the bottom of the retort and lines 32 and 34 in the retorting zone of the retort. Normally in such a conventional operation the spent shale exits retort 12 at a temperature of about 392° F. However, retort off gas introduced through line 30 extracts a certain amount of the sensible heat from the spent shale and the retort off gas is thereby heated to a certain extent.

In contrast to such conventional operations, in accordance with the present invention, a fuel is introduced to a combustor 36 through line 38 and a combustion supporting material, preferably air, oxygen-enriched air or oxygen, is introduced to combustor 36 through line 40. The fuel-air equivalence ratio to combustor 36 is, as previously indicated, near stoichiometric so as to burn essentially all of the fuel and produce a high temperature effluent essentially free of particulates and unburned or partially burned fuel and comprising essentially $N_2$ and $CO_2$. Where it is desired to carry out the pyrolysis in retort 12 at an elevated pressure, combustor 36 will be operated as a high intensity or high pressure burner to thereby produce an effluent having a high pressure as well as a high temperature. The effluent from combustor 36 is then passed to retort 12 through line 42 and lines 30, 32 and 34, respectively. As illustrated, the total combustor effluent, without the removal of components therefrom or separation, is introduced into retort 12. Preferably, the effluent from combustor 36 is passed directly to retort 12, either by directly coupling the combustor outlet to retort 12 or, where the effluent is to be introduced at more than one point, utilizing only such flow lines or distributor means, such as 30, 32 and 34, which are necessary to the distribution or multiple point introduction of the effluent into retort 12. It is to be seen that in this mode of operation, there is little or no loss of heat from the combustor effluent and the full benefit of the combustor heat is utilized in the retort. By supplying heat to the retort in this manner, there is also little or no combustion of hydrogen in the retort, as would be the case in a direct heated retort. Thus the hydrogen is present for the removal of sulfur and nitrogen (depending upon the temperature of operation and pressure), the reduction of coking in the retort and the upgrading of liquid products. In addition, where make-up hydrogen is to be added to a conventional retort or a hydroretort, the amount of make-up hydrogen is significantly reduced, thereby saving the energy normally necessary in a production of the make-up hydrogen. In accordance with the present invention, numerous options are available for the utilization of the retort off gas discharged through line 28, each of which has distinct advantages, depending upon the carbonaceous material being pyrolyzed and the desired pyrolysis products. In a preferred technique, the retort off gas is recycled to retort 12 through line 44. By contrast with an indirectly heated retort, the off gas passing through line 44 is not heated and therefore, it is substantially cooler than the heated off gas utilized in indirectly heated retorting operations. Consequently, the off gas of the present technique will extract substantially more sensible heat from the spent shale in the bottom of retort 12 and also cool the spent shale to a substantially lower temperature, thereby significantly reducing the necessity of quenching and other standard techniques necessary for subsequent handling and disposal of the spent shale. Preferably, the recycle off gas from line 44 is passed through line 30 only to the bottom of retort 12 so as to take full advantage of the cool recycle gas. Alternatively, the retort off gas can be recycled through line 46, mixed with the effluent from combustor 36 and then introduced to retort 12 through lines 30, 32 and 34 respectively. This mode of recycle can be advantageous if it is desired to cool or moderate the effluent from combustor 36 prior to introduction into retort 12. In yet another mode of operation, the retort off gas can be passed through line 48 to an appropriate separator 50 wherein hydrogen is separated and discharged through line 52, whereas the remaining gaseous product is discharged through line 54. In the particular instance shown, the preferred separator is what is known as a "pressure swing absorber". This particular separation technique is capable of producing highly concentrated hydrogen streams by removing almost any contaminating gases therefrom. Briefly, gases are passed through a unit containing an absorbent, such as molecular sieves, activated carbon, silica gel and the like, at a high pressure to preferentially pass the hydrogen while adsorbing contaminant gases on the adsorbant. Thereafter, the adsorbant is purged of contaminant gases by lowering the pressure without any significant change in temperature. Such an operation is described in detail in "PRESSURE SWING ADSORPTION", Chemical Engineering Progress, Vol. 65, No. 9, Sept. 1969, pp. 78–83. The separated hydrogen passing through line 52 can then be recycled to the retort 12 at an appropriate point, which as shown in the drawing is to line 42 carrying effluent from combustor 36. The gases separated from the hydrogen and passing through line 54 can be utilized in several ways, depending upon the concentration of combustibles or calorific value (CV) of the gases. Specifically, the gas can be passed through line 56 and thence line 58 to the combustor 36 to provide a part of the fuel for the combustor. To the extent that the combustible concentration is too low to support combustion in combustor 36, even when mixed with another fuel, combustor 36 can be operated as a two-stage rich-lean combustor. In this mode of operation, the fuel-air ratio to the upstream end of combustor 36 is above the stoichiometric ratio and therefore a fuel-rich mixture is burned in the upstream end of combustor 36. The low CV gas is then introduced at an intermediate point in combustor 36 through line 60 where supplemental air is introduced through line 62 so that the total air to combustor 36 is essentially equal to stoichiometric fuel-air ratio or above. The remaining unburned or partially burned fuels from the fuel-rich upstream end of combustor 36, together with the off gas through line 60 are then completely burned in the downstream or fuel-lean section of combustor 36. Again, depending upon the nature of the operation as well as the nature of the retort off gas, at least a part of the off gas can be recovered as a gas product for other uses through lines 68 or 70, respectively. Where it is desired to add hydrogen from an external source to the retorting operation such make-up hydrogen may be appropriately added through line 72, 74 or 76. Another distinct advantage, in accordance with the present invention, exists where the carbonaceous material, such as the western or Green River type of oil shale, contains substantial amounts of carbonates. As previously indicated, in conventional operations such carbonates normally break down into calcium oxide (lime) and carbon dioxide, resulting in the absorption of substantial amounts of heat. By contrast, since the effluent gas from combustor 36 contains substantial amounts of $CO_2$, the calcium carbonate reaction is shifted to a combination with silicone dioxide (quartz) in the formation of calcium silicate (wollastonite) and carbon dioxide. The latter reaction absorbs substantial less heat and therefore is much less detrimental to operation of the retorting reaction.

Figure 2:
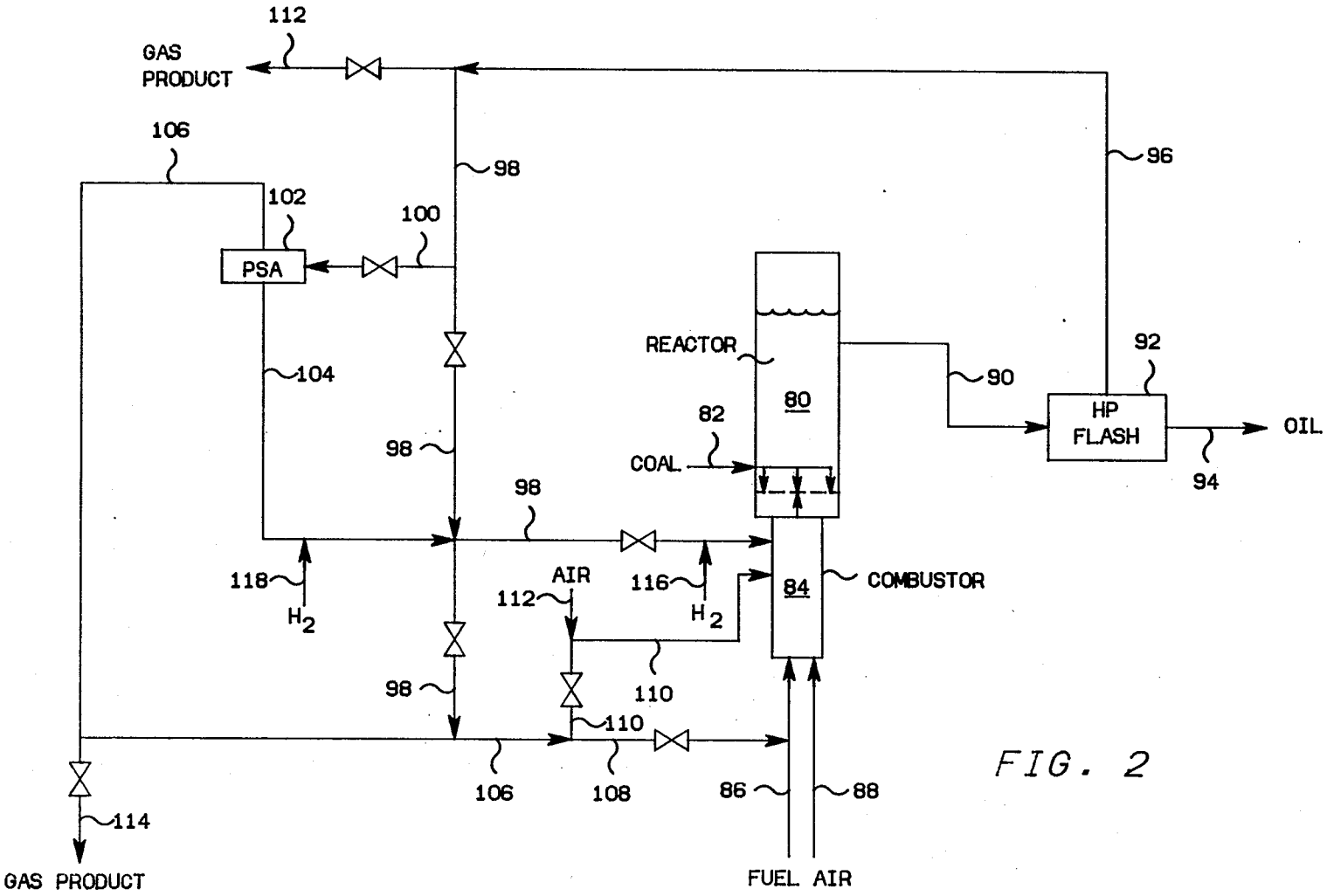
FIG. 2 of the drawings is a flow diagram illustrating a method of pyrolyzing coal in accordance with another aspect of the present invention.

FIG. 2 of the drawings illustrates a technique, in accordance with the present invention, wherein coal is pyrolyzed in a fluid bed reactor 80. Such a fluid bed may be a dense phase fluidized bed, an ebullated bed or an entrained flow or slurry bed, as desired. While FIG. 2 is illustrated utilizing coal as the carbonaceous material, it is also to be understood that any other normally solid carbonaceous material can be utilized.

In accordance with FIG. 2, coal is introduced through line 82 above an appropriate distributor means in reactor 80. Fuel and air are introduced to combustor 84 through lines 86 and 88, respectively. Combustor 84 corresponds to combustor 36 of FIG. 1. Combustor 84 is therefore operated in essentially the same manner as combustor 36 of FIG. 1, except that combustor 84 is shown directly coupled to reactor 80. Also, in a fluid bed type operation, it is highly advantageous to utilize the effluent from combustor 84 as a fluidizing medium in reactor 80. Liquid and gaseous products from reactor 80 are discharged through line 90 to an appropriate liquid gas separation means 92, which in the specific instance shown is a high pressure flash system. Separated liquid product or oil is discharged through line 94, while a gaseous product is discharged through line 96. Essentially the same options for the utilization of the pyrolysis off gas, as were available in the system illustrated in FIG. 1, are also available in accordance with the present system. Consequently, the off gas can be passed through line 98 and added to the effluent from combustor 84 at the downstream end of combustor 84. Alternatively, at least a part of the off gas can be passed through line 100 to a separator 102 wherein hydrogen is separated from the remaining gases and discharged through line 104, while the remaining gases are discharged through line 106. As was the case in FIG. 1, separator 102 is preferably a pressure swing adsorber. The hydrogen from line 104 would then pass through line 98 to the downstream end of combustor 84 for introduction into reactor 80 along with the effluent from combustor 84. The remaining portion of the off gas passing through line 106 may be utilized as a fuel in combustor 84 by passage through line 108 or, as previously described with reference to FIG. 1, combustor 84 may be operated as a two-stage, rich-lean combustor and the off gas from line 106 may be passed through line 110, combined with additional air through line 112 and introduced into combustor 84 at a midpoint in the combustor which separates the fuel-rich upstream end of the combustor from the fuel-lean end. As was the case in FIG. 1, off gases may be withdrawn as a gas product for other uses through lines 112 or 114, respectively. Likewise, make-up hydrogen may be added through lines 116 or 118, respectively.

FIGS. 3–7 of the drawings illustrate combustors particularly useful in accordance with the present invention, as combustors 36 and 84 of FIGS. 1 and 2, respectively, and modifications thereof, which permit utilization of a wide variety of fuels, variation of the type of combustion and control over the heat and/or pressure of the effluent from the burner.

Figure 3:
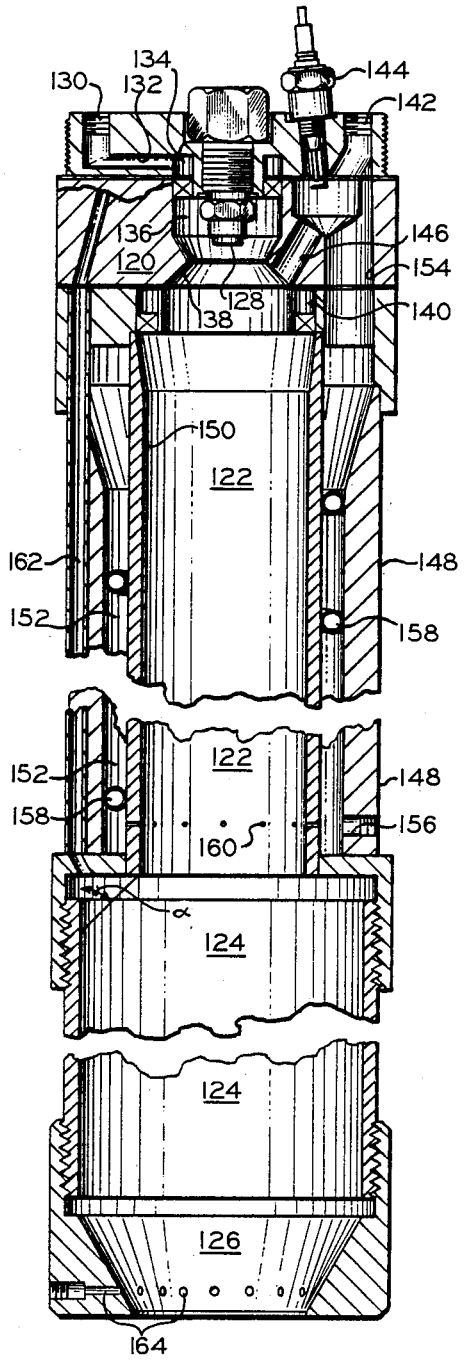
FIG. 3 is an elevational view, partially in cross section, of a combustor utilizable in accordance with the present invention.

FIG. 3 of the drawings is a schematic drawing, in cross section, of a basic combustor. One of the distinct advantages of this combustor is that it is capable of utilizing any readily available type of fuel from gaseous-to-liquid-to-solid fuels with minor modifications. In general, such modifications involve only replacement of the combustor head and/or, in some cases, the combustor chamber. Accordingly, it is highly advantageous to attach the head to the main body of the device so that it may be removed and replaced by a head adapted for use with different types of fuels. In addition, sight glasses can be provided along the body at appropriate points in order to observe the flame, etc. It is also possible to monitor the character of the mixture of effluent gas and therefore make appropriate adjustments for control of the feed fluids.

The combustor comprises four basic sections or modules, namely, a combustor head 120, a combustion chamber 122, a second combustor or mixing chamber 124 and an exhaust nozzle 126. As previously pointed out with respect to the combustor head, all of the modules are connected in a manner such that they are readily separable for the substitution of alternate subunits, servicing, repair, etc. In some cases, however, the combustion chamber 122 and combustion or mixing chamber 124 can be permanently connected subunits, since the unit can be designed so that these two subunits can be utilized for most types of fuel and alternate types of operation. In certain instances it may also be desirable to substitute a different exhaust nozzle or a different fuel introduction means. Details of such modifications will be set forth hereinafter.

Air and fuel are brought to the combustor head 120 in near stoichoimetric quantities, generally with 3% excess oxygen on a dry basis. As previously indicated, the fuel can be gaseous, such as hydrogen, methane, propane, etc., liquid fuels, such as gasoline, kerosene, diesel fuel, heavy fuel oils, crude oil or other liquid hydrocarbon fractions, as well as normally solid fuels, such as solvent refined coal (SCR I), asphaltenes, such as asphaltene bottoms from oil extraction processes, carbonaceous solids, as coals, lignites, etc., water-fuel emulsions, for "explosive atomization", water-fuel solutions for "disruptive vaporization" of fuel droplets, etc. A fuel introduction means 128 is mounted along the axis of head 120 to introduce fuel centrally and axially into the combustion chamber 122. In the particular instance schematically shown herein, the fuel introduction means 128 is an atomizing nozzle adapted for the introduction of a liquid fuel. Such atomizing nozzles are well known in the art and the details thereof need not be described herein. However, the nozzle may be any variety of spray nozzles or fluid assist nozzles, such as an air assist or steam assist nozzle. Obviously an air assist nozzle, where such assistance is necessary, is preferred if there is no readily available source of steam and to prevent dilution in the combustion chamber. In any event, the nozzle 128 sprays the appropriately atomized liquid fuel in a diverging pattern into the combustion chamber 122. Combustion supporting gas, particularly air, could be supplied to individual air plenums, so that the relative volumes of air could be adjusted, rather than depending solely upon the relative open areas of the entries to the combustion chamber, or individual lines to each opening. In either event, a first volume of air is introduced through a plurality of vertically disposed channels 130. From channel 130 the first volume of air flows through tangential channels 132 and thence to annular plenum chamber 134. Passage through the tangential channels 132 imparts a swirling or rotational motion to the air. The rotating air then enters mixing or contact chamber 136 where it begins contact with the fuel exiting from nozzle 128. The fuel exiting from nozzle 128, preferably exits the nozzle in a cone-shaped pattern having an angle, preferably of about 45°. The first volume of air from mixing chamber 132 is reduced in diameter by a baffle or nozzle-type restriction 138. This reduction in diameter of the air aids in the mixing of the combustion air and the fuel which begins at the downstream end of the mixing chamber 136. As the mixture of air and fuel expands into the exit end of mixing chamber 136, a well mixed mixture of fuel and air travels downstream into the combustion chamber 122 as a body of fluids rotating in a counterclockwise direction and moving axially through the combustion chamber. Normally, the larger diameter of combustion chamber 122 as opposed to mixing chamber 136 would cause expansion of the counterclockwise rotating mixture of fuel and air toward the walls of combustion chamber 122. However, in the present case, this is prevented to a great extent by a second volume of air. A second volume of air enters from a common plenum (not shown) through longitudinally disposed bores (not shown) thence through tangential bores (not shown) and into annular plenum 140. These supply channels for the second volume of air are substantially the same construction and character as those utilized for introducing the first volume of air, with the exception that the channels introducing the second volume of air cause the second volume of air to rotate in a clockwise direction or countercurrent to the direction of rotation of the first volume of air. The second volume of air in traveling downstream through combustion chamber 122 will have a tendency to move toward the axis of combustion chamber 122 and, as previously indicated, the first volume of air will have a tendency to move toward the walls of combustion chamber 122, thus a high velocity shear surface exists between the two countercurrently flowing volumes of fluid and the hottest portion or core of the flame traveling along the axis does not contact the walls of the combustion chamber, thereby preventing burning of the walls and the formation of deposits along the walls, particularly where heavy fuels are utilized. However, the intense mixing which occurs at the interface between the two volumes of fluids does create considerable mixing and by the time the two volumes reach the downstream end of combustion chamber 122, substantially complete mixing has occurred and therefore substantially complete combustion. In addition, the central vortex has also essentially collapsed and a uniform, cross section or "plug" flow of fuel gas exists. Lighting or ignition of the generator is accomplished by supplying a gaseous fuel through channel 142 and air through a channel (not shown), which contact one another adjacent the downstream end of spark plug 144. This burning flame then passes through channel 146 into mixing chamber 136 where it ignites the first volume of air-fuel mixture in mixing chamber 136.

The combustion chamber includes an outer casing 148 and an inner burner wall 150, which form an annular water or air passage 152 therebetween. Water passage 152 is supplied with water through water conduit 154 and cools the combustion chamber, exiting through conduit 156. In order to prevent the formation of air bubbles or pockets in the body of cooling water, when water is the cooling medium, particularly toward the upper or upstream end of the channel, water swirling means 158 is spirally wound in the water channel 152 to direct the water in a spiral, axial direction through the channel. The water swirling means 158 can be a simple piece of tubing or any other appropriate means. A primary concern in the operation of the generator is combustion cleanliness, that is the prevention of deposits on the wall of the combustion chamber and production of soot emmissions as a result of incomplete combustion. This becomes a particular problem where heavy fuels are utilized and the problem is aggravated as combustor pressure increases and/or combustion temperature decreases. In any event, the manner of introducing the air into the generator substantially overcomes this problem. The counter rotating streams of air in the combustion chamber provide for flame stabilization in the vortex-flow pattern of the inner swirl with intense fuel-air mixing at the shear interface between the inner and outer streams of air for maximum fuel vaporization. Also, this pattern of air flow causes fuel-lean combustion along the combustion chamber walls to prevent build up of carbonaceous deposits, soot, etc. Following passage of the air through channel 152, where air is the cooling medium, the air can be injected into the combustion products or fuel gases from combustion chamber 122 through appropriate holes or apertures 160. This permits operation of the combustor as a two-stage, rich-lean combustor, the air introduced to the upstream end of the combustor being sufficient to produce a fuel-rich mixture for fuel-rich combustion in section 122 and the air through apertures 160 being sufficient to produce an overall fuel-lean mixture for completion of combustion in section 124. If retort or pyrolysis off gas is to be injected at this intermediate point in the combustor, the off gas can be injected through conduit 156. Also if the combustor is not cooled by indirect heat exchange with air or water, the air or air and off gas can be introduced through conduit 156 and apertures 160. If the combustor is to be operated as a single-stage burner, then all of the air for essentially complete combustion is introduced at the upstream end of the combustor and neither air nor off gas is introduced through conduit 256 and apertures 160 and section 124 simply becomes an extension of section 122. This obviously provides wide flexibility in the operation of the combustor. This is possible because section 160 can be sized for maximum residence time for effective and efficient fuel-rich combustion of the fuel in use and the combination of sections 122 plus 124 will effectively and efficiently provide completion of the two-stage combustion or single stage combustion since there is a minimum residence time for such complete combustion in two-stage combustion but there is essentially no maximum residence time for complete combustion in either the two-stage or single stage modes of combustion. Another extremely important factor, in the operation of the combustor of the present invention, as a two-stage burner, is the prevention of feedback of excessive amounts of air or off gas from section 124 into the combustion section 122, because of the chilling effect which such feedback would have, and dilution effects and other interference with the fuel-rich combustion. Such feedback is prevented by the axial displacement of the vortex flow patterns from the counter rotational air flow. Another extremely important factor in the operation of the combustor is the manner of introduction of air or off gas into the effluent of section 122. In accordance with the present invention, such introduction is accomplished by introducing the air or off gas as radial jets into the effluent gases, such jets preferably penetrating as close as possible to the center of the body of combustion products. The combustion products-air or off gas mixture is then abruptly expanded as it enters chamber 124. Accordingly, substantially complete mixing will occur. Abrupt expansion in the present case is meant to include expansion at an angle (alpha) significantly greater than 15°, since expansion at about 15° causes streamline flow or flow along the walls rather than reverse mixing at the expander. By the time the mixture of combustion products and air reach the downstream end of chamber 124, substantially complete combustion is attained. As will be discussed in greater detail hereinafter, exhaust nozzle 126, designed to discharge the effluent from the combustor, controls the pressure of discharge. Channel 162 passes through combustor head 120 into chamber 124 for the insertion of a thermocouple. Additional inlets may be directed into chamber 124 or nozzle 126 at any point after termination of the combustion, but is preferably through apertures 164 in nozzle 126 immediately adjacent the outlet, in order to take advantage of the expansion into a reactor to aid mixing. Off gas or hydrogen from lines 46 or 52 of FIG. 1 or off gas or hydrogen from lines 98 or 104 of FIG. 2 may be introduced through apertures 164. Quench air of other quench fluid can also be introduced through apertures 164 to control the temperature of the effluent from the combustor.

Figure 4:
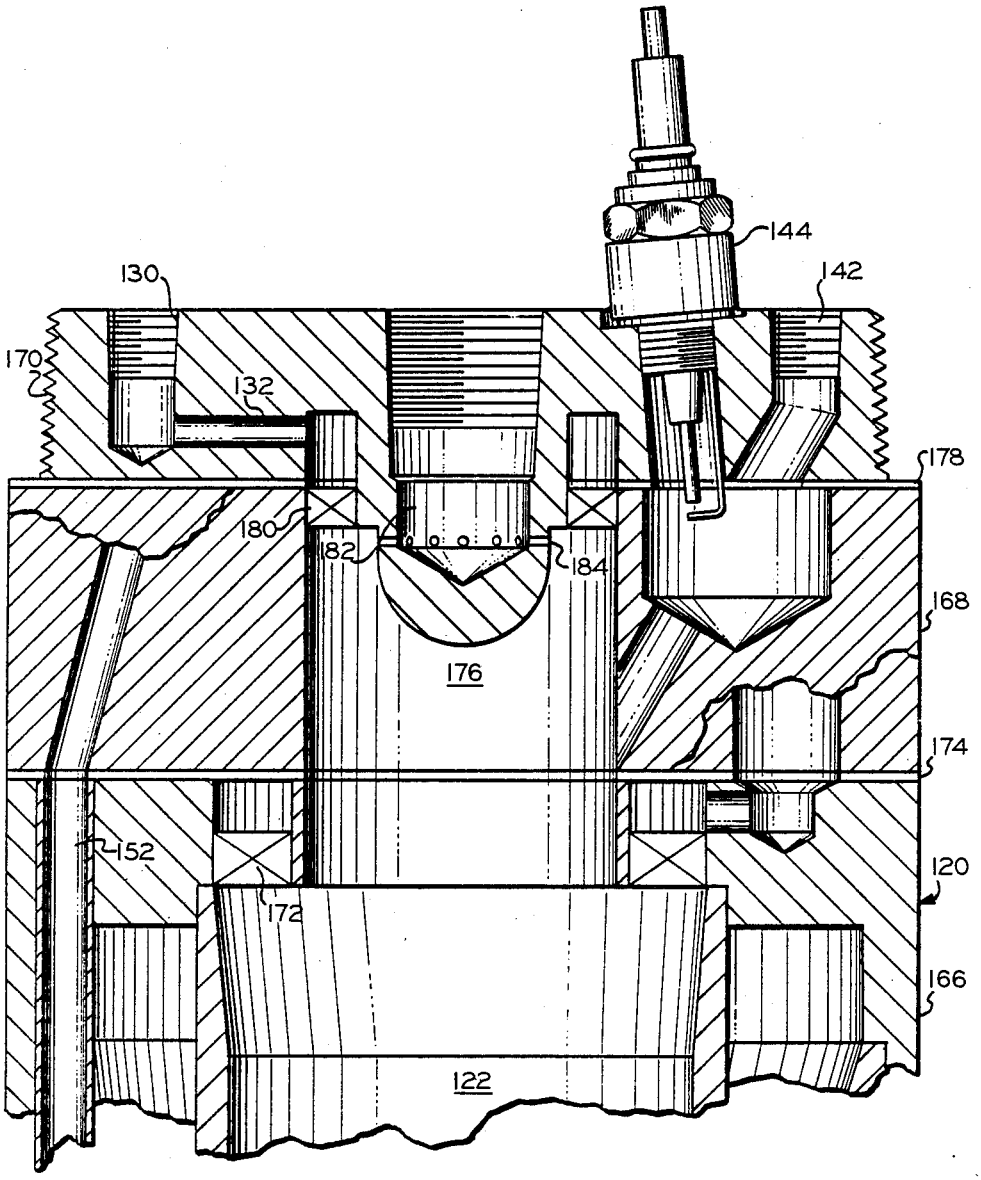
FIG. 4 is an elevational view, partially in cross section, of a modified upstream portion of a combustor for use in accordance with the present invention.

FIG. 4 is a partial elevational view of a generator, in accordance with the present invention, shown in partial cross section. The particular combustor head shown in FIG. 4 is designed for use of a gaseous fuel, such as natural gas. Primarily, the differences between this and the previously described combustor head lie in the fuel nozzle, the swirlers and the mixing chamber. Appropriate, numbers corresponding to those utilized in FIG. 3 are utilized on corresponding parts in FIG. 4. The adaptability of the generator of the present invention to replacement of modified parts is also discussed in greater detail with relation to FIG. 4.

Referring specifically to the combustor of FIG. 4, combustor head 120 can be constructed, as shown, in three separate sections, namely, a downstream section 166, a middle section 168 and an upstream section 170. In this particular instance, section 166 is welded to combustion chamber 122. However, as will be pointed out hereinafter, swirler 172, shown schematically, can be readily inserted in downstream section 166 before sections 168 and 170 are attached thereto. An appropriate gasket 174 is mounted between downstream section 166 and middle section 168 and section 168 is mounted on section 166 by means of appropriate threaded bolts. Section 166, as is obvious, also has formed therein the downstream end of a modified mixing chamber 176. This downstream portion of mixing section 176 is the same as the downstream mixing portion of mixing chamber 136 of FIG. 3 and, therefore, section 166 need not be modified except for the swirler in order to substitute corresponding parts of the device of FIG. 3 and provide a modified mixing chamber 176. Mixing chamber 176 of FIG. 4 does not contain the restriction means 138 of FIG. 3, since a gaseous fuel is utilized in FIG. 4 and complete mixing can be obtained with the air without the use of restriction 138 (FIG. 3). Section 170 of the combustor head 120 is similarly attached to section 168 through a gasket 178 therebetween. A modified swirler 180, shown schematically, is similar to swirler 172 and can be readily mounted in section 168 prior to the attachment of section 170. Section 170 has mounted axially therein a modified nozzle 182. Since a gaseous fuel is to be utilized in the present burner, a simple nozzle 182 with apertures 184 radiating therefrom and feeding gaseous fuel into mixing chamber 176 can be utilized. It is also obvious that either nozzle 138 of FIG. 3 or nozzle 182 of FIG. 4 can be threadedly mounted in section 170, thereby requiring only replacement of the nozzle if desired. A torch igniter, as shown, may be utilized in this embodiment or a simple electrode or spark plug. Section 170 contains the same air channels 130 and 132 as the combustion head of FIG. 3, but it is not necessary that tangential channels 132 be utilized. It is to be noted that the swirlers 172 and 180 can include a simple internal ring with blades or fins radiating therefrom and at an appropriate angle. In the present case, the angle of the blades is 45°. Accordingly, the ring serves the same purpose as the tangential channels of FIG. 3. In addition, these rings can be simply mounted in sections 166 and 168 in combustor head 120 prior to the assembly thereof. As previously indicated, when utilizing the swirler rings, the tangential air introduction is not necessary, but may be retained for convenience of manufacture without adversely affecting the operation of the device. In any event, the swirlers 180 and 172 introduce the first and second volumes of air, respectively, in a rotating, axial direction toward the downstream end of a combustor and in a counterrotative direction.

Up to this point combustor heads adapted to operate on fuels ranging from gaseous-to-liquid-to-solid have been described. Since complete combustion of a fuel requires an increased residence time the heavier or more difficult to burn the fuel becomes, gases normally require the lowest residence time, light liquids next, heavy liquids still higher and normally solid fuels the highest. Several alternatives are available within the scope of the present invention. As previously indicated, the combustor of the present invention is modular and combustion chambers of sufficient length to provide the necessary residence time for the fuel to be utilized can be substituted in the generator. Alternatively, a single combustion chamber having a sufficient length to provide adequate residence time for complete combustion of the heaviest fuel to be utilized, for example, crude oil or normally solid fuels can be utilized and the same combustion chamber utilized for all fuels contemplated. It is to be recognized, of course, in this case, that the combustion chamber would be longer than necessary for the lighter fuels.

A shorter combustion chamber and/or the same length combustion chamber for heavier fuels can also be utilized by placing at least one diametric restriction in the combustion chamber. The restriction means may be simple orifice plates adapted to reduce the diameter of the combustion chamber and thereafter abruptly expand the fluids into the portion of the combustion chamber downstream of the orifice. Restriction means tapered at their upstream ends, in order to eliminate sharp corners where deposits can collect, can also be used. This promotes more complete utilization of the air and more complete combustion. Rotational motion occurs toward the walls thence back toward the center of the flame and also serves to cool the downstream side of the orifice means thus preventing deposit formation thereon and further serves to prevent excessive backflow from the downstream side of the orifice to the upstream side. While the size of the orifice will vary, depending upon the degree of mixing with the air film on the walls of the combustion chamber and the nature of the fuel, the size can be readily optimized experimentally to minimize pressure drop while achieving complete combustion. For example, however, where a No. 2 fuel oil is to be burned, an orifice creating a 30% reduction in open area could be utilized and the orifice mounted about half way down the combustion zone. Since the external dimension of the generator described is about six inches, the combustion chamber is made of metal and is cooled with water in order to prevent internal burning and the formation of deposits on the interior of the combustion chamber. However, with a larger diameter, the combustion chamber can also comprise an outer metal casing, an internal ceramic lining and an insulating blanket wrapped around the ceramic liner between the ceramic liner and the metal casing. The ceramic liner alleviates burning of the interior of the combustion chamber or burner deposit problems, encountered when utilizing a metallic combustion chamber. The insulating blanket protects the metal outer wall from excessive heating.

To attain efficient operation, the design and operation of the unit should be at the design combustion chamber flow velocity, which in turn produce the design output pressure of the unit. If the combustion chamber is operated at the design flow velocity, sufficient residence time in the combustion chamber is provided to vaporize and/or, assuming, of course, that the fuel/air ratio is maintained for stoichiometric operation, for example 3% excess $O_2$ on a dry basis, burn a given fuel. Operation at a higher combustion chamber flow velocity results in incomplete combustion, accompanied by excessive deposits in the burner, excessive carbon particles in the output fluids and possible flame out. Operation at a lower combustion chamber flow velocity results in a reduced heat output below the design heat output of the burner. The design flow velocity in the combustion chamber (and in turn the design output pressure) is, in turn determined by the fuel and air flow rates.

Figure 5:
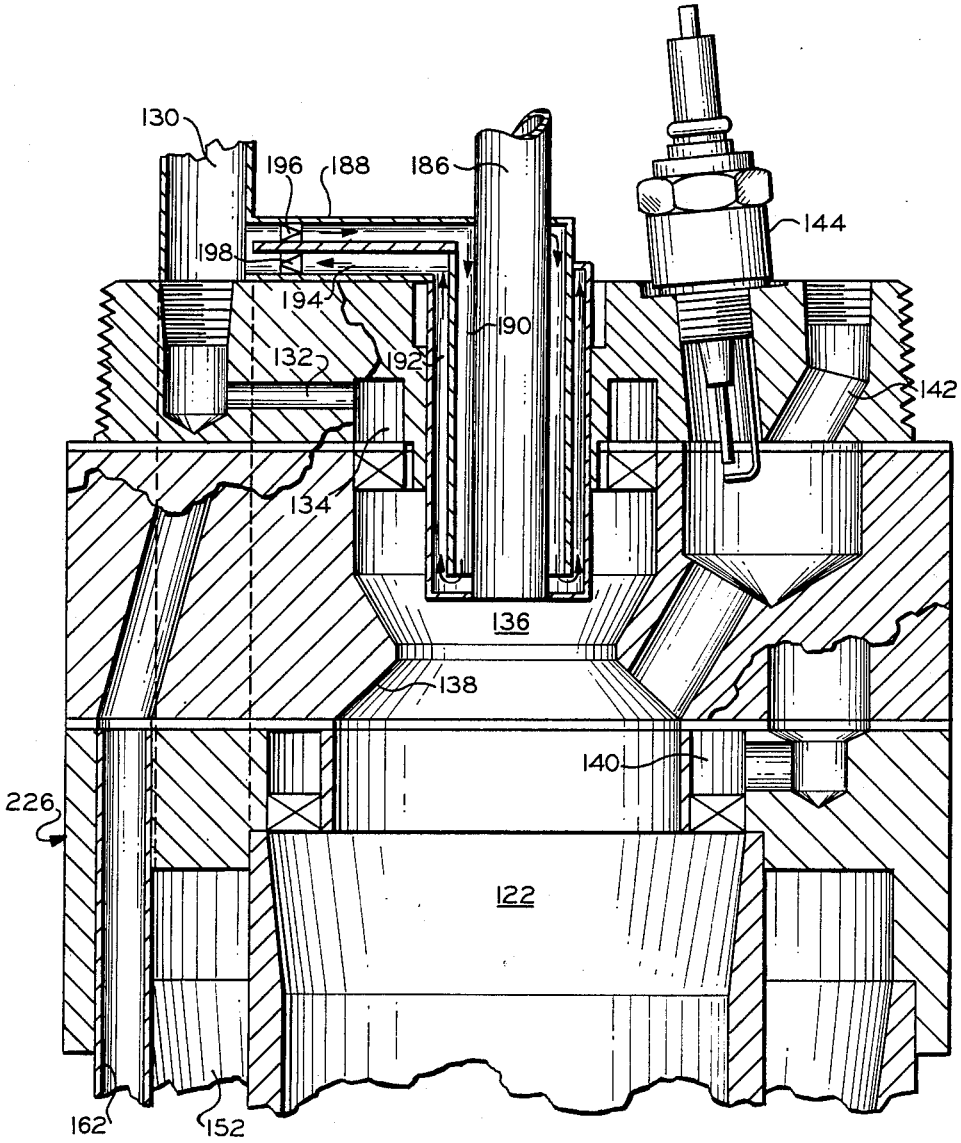
FIG. 5 is an elevational view, partially in cross section, of yet another modification of the upstream end of a combustor for use in accordance with the present invention.

FIG. 5 of the drawings sets forth an elevational view, partially in cross section, of yet another embodiment of a combustor head, in accordance with the present invention. Where appropriate, numbers which are duplicates of those appearing in FIG. 3 of the drawings are utilized to illustrate the same items in FIG. 5. The combustor head of FIG. 5 is adapted to burn solid, ashless fuels, such as solvent refined coal (SRC I) and asphaltene bottoms from oil extraction processes, etc., or other carbonaceous fuels, as coal, lignite, etc. Some of these fuels have melting points above about 250° F. and are, therefore solids at the temperature of introduction to the burner. Fuel would be pulverized to a suitable fineness and fed to the burner dispersed in a suitable carrier fluid, usually a portion of the air. The fuel is introduced to the combustor head by introduction means. In this case, introduction means 186 is simply a straight pipe. Since such solid fuels often become tacky as they approach their melting points, introduction means 186 is open without constrictions of any kind on the downstream end thereof. Also, because of the tendency of such fuels to become tacky and therefore stick to hot surfaces, causing fouling and eventual plugging, the tip of introduction means 186 is cooled to prevent build up of the solid fuel on the inner surfaces of the tip and the plugging thereof. Such cooling is conveniently carried out by taking a small side stream of water from water introduction conduit 130 and passing the same through conduit 188, thence through annular passage 190 surrounding introduction means 186 and returning the same through annular passage 192 and conduit 194 back to water conduit 130. Flow of the water through the cooling jacket can be appropriately controlled, as by means of one-way valves 196 and 198.

Figure 6:
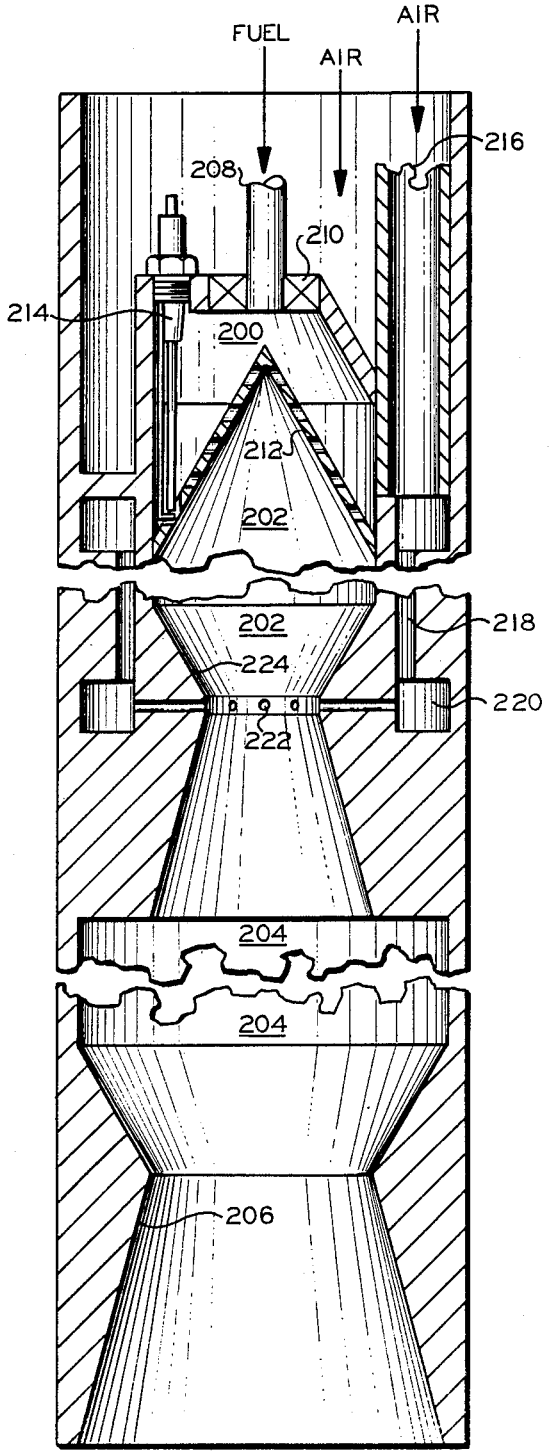
FIG. 6 is an elevational view, partially in cross section, of another combustor utilizable in accordance with the present invention.
Figure 7:
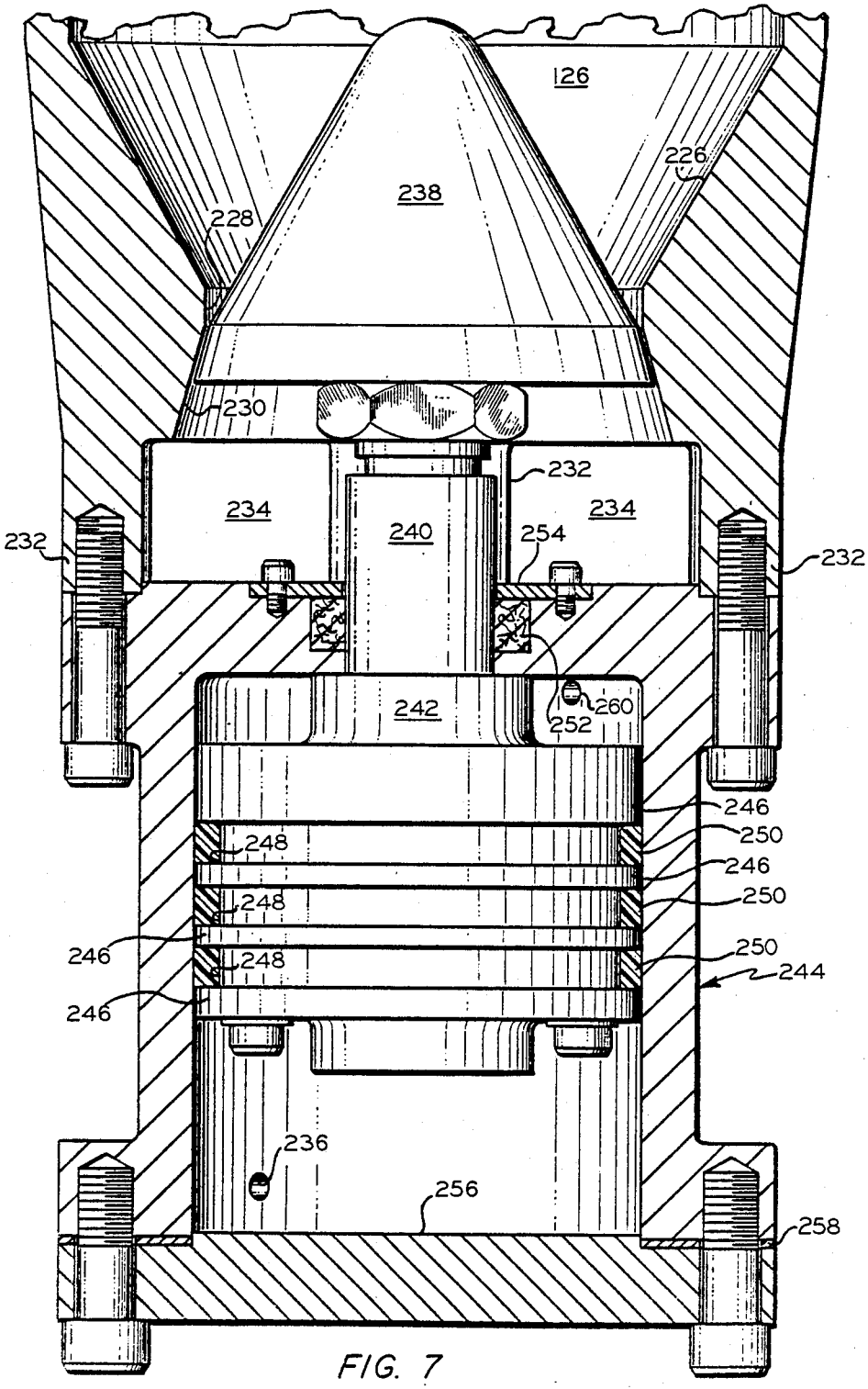
FIG. 7 is an elevational view, partially in cross section, of a pressure control means for combustors utilizable in accordance with the present invention.

FIG. 6 of the drawings illustrates another combustor, which can be used in accordance with the present invention. The apparatus of FIG. 6 is designed for the use of a normally gaseous fuel. The apparatus basically comprises a mixing zone 200, a combustion zone 202, a quench or cooling chamber 204 and a discharge nozzle 206. Fuel is introduced through fuel introduction 208, as a generally axial stream, into mixing zone 200. Air is introduced into the mixing zone 200 through an appropriate swirl means 210. Swirl means 210 can be any of the well known means for creating a swirling annular stream of air, such as an annular ring with fins at appropriate angles, a plurality of peripheral, tangential introduction ports or the like. The fuel and air are partially mixed in mixing zone 200 and are then passed through barrier means 212. Barrier means 212 is a suitable perforated grid, which together with the axial introduction of the fuel and the annular introduction of the air creates an annularly stratified body of fluids, which is fuel-rich along the axis of combustion zone 202 and fuel-lean adjacent the walls of combustion zone 202. The grid absorbs heat and prevents flashback of the flame into fuel-air mixing zone 200. Additionally, this stabilizes the flame in combustion zone 202 at the very high flow velocities employed in accordance with the present invention. Grid 202 also increases the flow velocity. Ignition of the fuel-air mixture is affected by spark plug 214. For two-stage, rich-lean combustion, air or air and off gas is introduced through line 216, passes through annular chamber 218 in indirect heat exchange with the combustion zone, thence, into annular plennum 220 and finally is introduced into the flame front through a plurality of peripherally spaced apertures 222. Utilization of the air in indirect heat exchange with the combustion zone 202, at least in part, permits the utilization of a metal combustion chamber as opposed to a ceramic lined combustion chamber. A ceramic lined chamber would be easily fractured under the conditions employed in accordance with the present invention. In addition, the use of a metallic combustion chamber permits one to construct a generator having a relatively small diameter, in the case illustrated about six inches in diameter. In the apparatus shown, the air in passing into the flame front, as a plurality of radial jets, aids in the mixing of the air with the flame front and thus the abrupt termination of the fuel-rich reaction. In addition, the air is injected in the vena contracta of a nozzle 224. Nozzle 224 serves to reduce the diameter of the flame front and thereafter expand the same. This reduction and abrupt expansion aid the mixing of the air with the flame front and also prevents back flow of the air into the combustion zone 202. It should be recognized that the air can be introduced immediately before or immediately after the vena contracta. It should also be recognized that the angle of expansion can be varied within certain limits. The fuel-lean effluent is then passed to chamber 204 of suitable dimensions to permit the mixture to complete combustion. Exhaust nozzle 206 may not be necessary in all cases, since its primary function is to produce a product of uniform composition and velocity. However, nozzle 206 could serve as a mixing nozzle for the addition of hydrogen, off gas or air for cooling by introducing the fluids immediately before, into, or immediately after the vena contracta of the nozzle 206. For operation in a single stage mode, all air would be introduced through swirler 210, no fluids would be introduced through apertures 222, thus making nozzle 224 another mixing means and sections 202 plus 204 would constitute the combustion zone.

As previously indicated, air and fuel flow, and consequently, the air-fuel ratio, can be controlled to maintain proper stoichiometry for clean combustion. However, even with control over the stoichiometry and adjustment of air and fuel flow rates to maintain the design point residence time in the combustor, the pressure may need to be modified to suit a particular pyrolysis operation. Consequently, it is desirable to control the pressure in the combustor to at all times maintain the desired pressure at or near the design point pressure. This is accomplished in accordance with the present invention by variations of the outlet nozzle 126 (FIG. 3) or 206 (FIG. 6) of the combustor.

The nozzle 126, attached to the downstream end of the combustor, is a major factor in the control of the combustor outlet pressure. In order to effect such control, a pressure sensor is disposed in the downstream end of the combustor and is connected to a line which transmits the sensed pressure to a control location. In the embodiment illustrated in FIG. 7, the nozzle 126 is formed by reducing the diameter of the flowing fluids by converging the wall 226 to form a reduced diameter section or vena contracta 228 and thereafter diverging the wall 230. In order to prevent interference of the nozzle with the flow of fluids, the angle of divergence of wall 226, is preferably below about 30° and the angle of divergence of the wall 230 is preferably below about 15°. However, it should be recognized that other appropriate openings may be utilized. When the fluids are discharged through nozzle 126 an extension 232 is provided at the downstream end of the nozzle for attachment of the hereinafter mentioned valve. The extension 232 has formed therein a plurality of openings 234 about the periphery for the discharge of fluids from the burner. At least one operating fluid opening 236 is connected to a source of a pressurized operating fluid at the control location.

The pressure control means comprises a plug means 238, a connector or stem 240 and a piston 242 mounted in the piston chamber 244. Plug 238 is a cone shaped plug contoured to prevent flow separation and cavitation. Such cavitation obviously will pit and wear away the solid surfaces of the plug and such erosion will be aggravated by high pressures and temperatures. In order to prevent such cavitation, it has been determined that the slope of the cone should be less than about 30° with respect to a vertical line from the periphery of the base. The piston 242 is also designed to withstand the severe conditions. For this purpose, piston 242 is formed of a plurality of disc-type segments 246 detachably coupled together to form the overall piston. A reduced diameter shoulder 248 is formed on one end of the disc-shaped segments so that when the segments are assembled to form piston 242, a plurality of annular channels will be formed about the periphery of the piston to receive a plurality of sealing rings 250. Thus, the segmented construction of piston 242 not only facilitates assembly and insertion of the annular sealing ring 250, but permits servicing to replace the sealing rings. Piston chamber 244 is detachably coupled to extension 232 of nozzle 126 and, because of its spacing from the end of nozzle 126, forms peripherally disposed openings 234 through which the fluids from the generator are discharged to the outside of the generator. Stem 240 passes through a central aperture in the upstream end of piston chamber 244 and moves therethrough in fluid tight relationship as a result of the mounting of annular seal 252 between the stem and the opening. Seal 252 is held in place by means of detachably mounted ring 254, thus again aiding assembly and servicing of the unit. Similarly, the downstream end of piston chamber 244 is closed by a detachable closure plate 256 with sealing gasket 258 therebetween. Plug 238 is also detachably mounted on piston 242 to facilitate assembly and servicing. In the particular instance shown, the pressure controller is operated by the injection of an operating fluid under pressure through aperture 236 into the void space at the upstream end of the piston chamber. The void space in the downstream end of piston chamber 244 is provided with at least one pressure relief hole 260. Thus, a single acting piston is shown. However, it is also obvious that a double acting piston can be utilized by injecting and withdrawing fluids from the void spaces at both the upstream end and the downstream end of the piston chamber.

Piston chamber 244 thus moves piston 242 toward and away from the nozzle at the lower end of the vaporization chamber, thus varying the annular space between plug 238 and diverging wall 230, thereby varying the pressure within the combustor and of discharge from the combustor. Fluids flowing from the combustor also act against plug 238. Accordingly, accurate and complete control of the pressure within the combustor and of the discharged fluids can be maintained.

While specific materials, items of equipment and assemblages of items of equipment have been referred to herein, it is to be understood that such references are by way of illustration and to disclose the best mode of operation, and are not to be considered limiting.

That which is claimed:

1. A process for the pyrolysis of normally-solid carbonaceous materials at an elevated temperature, comprising:

(a) burning a fuel in the presence of a combustion-supporting material in an essentially stoichiometric amount and sufficient to attain essentially complete combustion of all of said fuel to produce a combustion effluent comprising $N_2$ and $CO_2$ and having an elevated temperature;

(b) passing said combustion effluent, without removal of components therefrom, through said carbonaceous materials in a separate step and without reducing the temperature thereof between the burning step and contact of said combustion effluent with said carbonaceous materials to thereby produce an elevated temperature within said carbonaceous materials;

(c) pyrolyzing said carbonaceous materials in the presence of said combustion effluent, at the thus produced elevated temperature and in the absence of an oxidizing agent to thus prevent burning of components during said pyrolysis;

(d) withdrawing a gasiform effluent from said pyrolysis step;

(e) separating said gasiform effluent into a normally liquid phase and a normally gaseous pyrolysis off-gas;

(f) recycling at least part of said pyrolysis off-gas to said pyrolysis step; and (g) passing the thus recycled pyrolysis off-gas countercurrent to said carbonaceous materials in said pyrolysis step.

2. A process in accordance with claim 1 wherein the burning step is additionally carried out at a high flame velocity, whereby the effluent is also at an elevated pressure and said effluent is passed through the pyrolysis step without reducing said elevated pressure between said burning step and said pyrolysis step.

3. A process for the pyrolysis of normally-solid carbonaceous materials at an elevated temperature, comprising:

(a) burning a fuel in the presence of a combustion-supporting material in an essentially stoichiometric amount and sufficient to attain essentially complete combustion of all of said fuel to produce a combustion effluent comprising $N_2$ and $CO_2$ and having an elevated temperature;

(b) passing said combustion effluent, without removal of components therefrom, through said carbonaceous materials in a separate step and without reducing the temperature thereof between the burning step and contact of said combustion effluent with said carbonaceous materials to thereby produce an elevated temperature within said carbonaceous materials;

(c) pyrolyzing said carbonaceous materials in the presence of said combustion effluent, at the thus produced elevated temperature and in the absence of an oxidizing agent to thus prevent burning of components during said pyrolysis;

(d) withdrawing a gasiform effluent from said pyrolysis step;

(e) separating said gasiform effluent into a normally liquid phase and a normally gaseous pyrolysis off-gas; and (f) utilizing at least part of said pyrolysis off-gas as at least part of said fuel in said burning step.

4. A process for the pyrolysis of normally-solid carbonaceous materials at an elevated temperature, comprising:

(a) burning a fuel, in a two-stage, rich-lean burning step, in the presence of a combustion-supporting material, in an essentially stoichiometric amount and sufficient to attain essentially complete combustion of all of said fuel to produce a combustion effluent comprising $N_2$ and $CO_2$ and having an elevated temperature;

(b) passing said combustion effluent, without removal of components therefrom, through said carbonaceous materials in a separate step and without reducing the temperature thereof between the burning step and contact of said combustion effluent with said carbonaceous materials to thereby produce an elevated temperature within said carbonaceous materials; and (c) pyrolyzing said carbonaceous materials in the presence of said combustion effluent, at the thus produced elevated temperature and in the absence of an oxidizing agent to thus prevent burning of components during said pyrolysis.

5. A process for the pyrolysis of normally-solid carbonaceous materials at an elevated temperature, comprising:

(a) burning a fuel in the presence of a combustion-supporting material in an essentially stoichiometric amount and sufficient to attain essentially complete combustion of all of said fuel to produce a combustion effluent comprising $N_2$ and $CO_2$ and having an elevated temperature;

(b) passing said combustion effluent, without removal of components therefrom, through said carbonaceous materials in a separate step and without reducing the temperature thereof between the burning step and contact of said combustion effluent with said carbonaceous materials to thereby produce an elevated temperature within said carbonaceous materials;

(c) pyrolyzing said carbonaceous materials in the presence of said combustion effluent, at the thus produced elevated temperature and in the absence of an oxidizing agent to thus prevent burning of components during said pyrolysis;

(d) withdrawing a gasiform effluent from said pyrolysis step;

(e) separating said gasiform effluent into a normally liquid phase and a normally gaseous pyrolysis off-gas; and (f) separating said pyrolysis off-gas into a hydrogen-rich stream and a residual pyrolysis off-gas.

6. A process in accordance with claim 5 wherein the hydrogen-rich stream is recycled and passed through the pyrolysis step.

7. A process in accordance with claim 5 wherein the residual pyrolysis offgas is utilized as at least part of the fuel in the burning step.

8. A process in accordance with claim 5 wherein the burning step is a two-stage, rich-lean burning step and the residual pyrolysis offgas is introduced into said burning step adjacent to the downstream end of the rich burning stage.

9. A process in accordance with claim 8 wherein the hydrogen-rich stream is recycled and passed through the pyrolysis step.

10. A process for the pyrolysis of normally-solid carbonaceous materials at an elevated temperature, comprising:

(a) burning a fuel in the presence of a combustion supporting material in an essentially stoichiometric amount and sufficient to attain essentially complete combustion of all of said fuel to produce a combustion effluent comprising $N_2$ and $CO_2$ and having an elevated temperature;

(b) passing said carbonaceous materials sequentially through a preheating step, a pyrolysis step and a cooling step;

(c) passing said combustion effluent, without the removal of components therefrom, countercurrently through said carbonaceous materials in a separate step and without reducing the temperature thereof between the burning step and contact of said combustion effluent with said carbonaceous materials to thereby produce an elevated temperature within said carbonaceous materials;

(d) pyrolyzing said carbonaceous materials in the presence of said combustion effluent, at the thus produced elevated temperature and in the absence of an oxidizing agent to thus prevent burning of components during said pyrolysis;

(e) withdrawing a gasiform effluent from said preheating step;

(f) separating said gasiform effluent into a normally liquid phase and a normally gaseous pyrolysis off-gas;

(g) recycling at least part of said pyrolysis off-gas to said cooling step; and (h) passing the thus recycled pyrolysis off-gas through said cooling step, said pyrolysis step and said preheating step.

11. A process in accordance with claim 10 wherein the burning step is additionally carried out at a high flame velocity, whereby the effluent is also at an elevated pressure and said effluent is passed through the pyrolysis step without reducing said elevated pressure between said burning step and said pyrolysis step.

12. A process for the pyrolysis of normally-solid carbonaceous materials at an elevated temperature, comprising:

(a) burning a fuel in the presence of a combustion supporting material in an essentially stoichiometric amount and sufficient to attain essentially complete combustion of all of said fuel to produce a combustion effluent comprising $N_2$ and $CO_2$ and having an elevated temperature;

(b) passing said carbonaceous materials sequentially through a preheating step, a pyrolysis step and a cooling step;

(c) passing said combustion effluent, without the removal of components therefrom, countercurrently through said carbonaceous materials in a separate step and without reducing the temperature thereof between the burning step and contact of said combustion effluent with said carbonaceous materials to thereby produce an elevated temperature within said carbonaceous materials;

(d) pyrolyzing said carbonaceous materials in the presence of said combustion effluent, at the thus produced elevated temperature and in the absence of an oxidizing agent to thus prevent burning of components during said pyrolysis;

(e) withdrawing a gasiform effluent from said preheating step;

(f) separating said gasiform effluent into a normally liquid phase and a normally gaseous pyrolysis off-gas; and (g) utilizing at least part of said pyrolysis off-gas as at least part of said fuel in said burning step.

13. A process for the pyrolysis of normally-solid carbonaceous materials at an elevated temperature, comprising:

(a) burning a fuel, in a two-stage, rich-lean burning step, in the presence of a combustion supporting material in an essentially stoichiometric amount and sufficient to attain essentially complete combustion of all of said fuel to produce a combustion effluent comprising $N_2$ and $CO_2$ and having an elevated temperature;

(b) passing said carbonaceous materials sequentially through a preheating step, a pyrolysis step and a cooling step;

(c) passing said combustion effluent, without the removal of components therefrom, countercurrently through said carbonaceous materials in a separate step and without reducing the temperature thereof between the burning step and contact of said combustion effluent with said carbonaceous materials to thereby produce an elevated temperature within said carbonaceous materials; and (d) pyrolyzing said carbonaceous materials in the presence of said combustion effluent, at the thus produced elevated temperature and in the absence of an oxidizing agent to thus prevent burning of components during said pyrolysis.

14. A process for the pyrolysis of normally-solid carbonaceous materials at an elevated temperature, comprising:

(a) burning a fuel in the presence of a combustion supporting material in an essentially stoichiometric amount and sufficient to attain essentially complete combustion of all of said fuel to produce a combustion effluent comprising $N_2$ and $CO_2$ and having an elevated temperature;

(b) passing said carbonaceous materials sequentially through a preheating step, a pyrolysis step and a cooling step;

(c) passing said combustion effluent, without the removal of components therefrom countercurrently through said carbonaceous materials in a separate step and without reducing the temperature thereof between the burning step and contact of said combustion effluent with said carbonaceous materials to thereby produce an elevated temperature within said carbonaceous materials;

(d) pyrolyzing said carbonaceous materials in the presence of said combustion effluent, at the thus produced elevated temperature and in the absence of an oxidizing agent to thus prevent burning of components during said pyrolysis;

(e) withdrawing a gasiform effluent from said preheating step;

(f) separating said gasiform effluent into a normally liquid phase and a normally gaseous pyrolysis off-gas; and (g) separating said pyrolysis off-gas into a hydrogen-rich stream and a residual pyrolysis off-gas.

15. A process in accordance with claim 14 wherein the hydrogen-rich stream is recycled and passed through the pyrolysis step.

16. A process in accordance with claim 14 wherein the residual pyrolysis offgas is utilized as at least part of the fuel in the burning step.

17. A process in accordance with claim 14 wherein the burning step is a two-stage, rich-lean burning step and the residual pyrolysis offgas is introduced into said burning step adjacent the downstream end of the rich burning stage.

18. A process in accordance with claim 14 wherein the hydrogen-rich stream is recycled and passed through the pyrolysis step.

19. A process for the hydropyrolysis of normally-solid carbonaceous materials at an elevated temperature and in the presence of hydrogen; comprising:

(a) burning a fuel in the presence of a combustion-supporting material in an essentially stoichiometric amount and sufficient to attain essentially complete combustion of all of said fuel to produce a combustion effluent comprising $N_2$ and $CO_2$ and having an elevated temperature;

(b) passing said combustion effluent, without removal of components therefrom, through said carbonaceous materials in a separate step and without reducing the temperature thereof between the burning step and contact of said combustion effluent with said carbonaceous materials to thereby produce an elevated temperature within said carbonaceous material;

(c) simultaneously with passing said combustion effluent through said carbonaceous materials, passing hydrogen, in excess of that normally produced by the pyrolysis of said carbonaceous materials, through said carbonaceous materials; and (d) hydropyrolyzing said carbonaceous materials in the presence of said combustion effluent and said hydrogen, at the thus produced elevated temperature and in the absence of an oxidizing agent to thus prevent burning of components during said hydropyrolysis.

20. A process in accordance with claim 19 wherein the burning step is additionally carried out at a high flame velocity, whereby the effluent is also at an elevated pressure and said effluent is passed through pyrolysis step without reducing said elevated pressure between said burning step and said pyrolysis step.

21. A process in accordance with claim 19 wherein the effluent from the burning step is passed directly to the pyrolysis step.

22. A process in accordance with claim 21 wherein the burning step is directly adjacent to and in open communication with the pyrolysis step to thereby pass the combustion effluent directly to the pyrolysis step.

23. A process in accordance with claim 19 wherein a gasiform effluent is withdrawn from the pyrolysis step and said gasiform effluent is separated into a normally liquid phase and a normally gaseous pyrolysis offgas.

24. A process in accordance with claim 23 wherein at least a part of the pyrolysis offgas is recycled to the pyrolysis step and passed through said pyrolysis step countercurrent to the carbonaceous materials.

25. A process in accordance with claim 23 wherein at least part of the pyrolysis offgas is utilized as at least part of the fuel in the burning step.

26. A process in accordance with claim 19 wherein the burning step is a two-stage, rich-lean burning step.

27. A process in accordance with claim 23 wherein the pyrolysis offgas is further separated into a hydrogen-rich stream and a residual pyrolysis offgas.

28. A process in accordance with claim 27 wherein the hydrogen-rich stream is recycled and passed through the pyrolysis step.

29. A process in accordance with claim 27 wherein the residual pyrolysis offgas is utilized as at least part of the fuel in the burning step.

30. A process in accordance with claim 27 wherein the burning step is a two-stage, rich-lean burning step, and the residual pyrolysis offgas is introduced into said burning step adjacent the downstream end of the rich burning stage.

31. A process in accordance with claim 30 wherein the hydrogen-rich stream is recycled and passed through the pyrolysis step.

* * * * *